US009724954B2

(12) United States Patent
Taguchi

(10) Patent No.: US 9,724,954 B2
(45) Date of Patent: Aug. 8, 2017

(54) SHEET PASTING AND BINDING APPARATUS AND SHEET POST-PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Taguchi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 187 days.

(21) Appl. No.: 14/670,638

(22) Filed: Mar. 27, 2015

(65) Prior Publication Data

US 2016/0279998 A1 Sep. 29, 2016

(51) Int. Cl.
*B65H 37/02* (2006.01)
*B42C 9/00* (2006.01)

(52) U.S. Cl.
CPC ..... *B42C 9/0081* (2013.01)

(58) Field of Classification Search
CPC ..... B42C 9/0081; B65H 37/02
USPC ..... 270/58.09; 399/407, 408; 412/8, 37
See application file for complete search history.

(56) References Cited

U.S. PATENT DOCUMENTS 6,826,547 B1 * 11/2004 Silverbrook ..... B41J 2/17513 347/1
7,942,399 B2 * 5/2011 Hirai ..... B42C 9/0081 270/58.07
8,838,014 B2 * 9/2014 Matsue ..... B42C 1/12 399/408
9,346,648 B2 * 5/2016 Osada ..... B65H 37/04
2015/0063953 A1 * 3/2015 Taguchi ..... B42C 19/02 412/37
2015/0251475 A1 * 9/2015 Taguchi ..... B42C 9/0081 412/8
2015/0251869 A1 * 9/2015 Taguchi ..... B65H 37/02 412/11
2016/0207296 A1 * 7/2016 Terao ..... B42C 9/0075
2016/0229164 A1 * 8/2016 Taki ..... B42C 9/0075
2016/0279998 A1 * 9/2016 Taguchi ..... B42C 9/0081
2016/0303886 A1 * 10/2016 Umeda ..... B42C 1/125

* cited by examiner

*Primary Examiner* — Patrick Mackey
(74) *Attorney, Agent, or Firm* — Amin, Turocy & Watson LLP; Gregory Turocy

(57) ABSTRACT

A sheet pasting and binding apparatus has a paste application unit, an acquisition unit, a detection unit, and a controller. The paste application unit can change an application amount for applying paste to fed sheets. The acquisition unit acquires the number of printing instructed sheets. The detection unit detects the remaining amount of the paste. The controller controls the paste application unit so that pasting and binding are performed using a second paste application amount which is smaller than a first paste application amount while the pasting and binding are performed using the first paste application amount which is specified in advance as the paste application amount for maintaining a binding force between the sheets, based on the reception number and the remaining paste amount.

10 Claims, 10 Drawing Sheets

FIG. 6

MEMORY TABLE

| | PASTE APPLICATION AMOUNT PER UNIT NUMBER |
|---|---|
| FIRST PASTE APPLICATION AMOUNT (FOR USUAL MODE) | P1 |
| SECOND PASTE APPLICATION AMOUNT (FOR SAVING MODE) | P2 (<P1) |

FIG. 7

MEMORY TABLE (DEPENDING ON TYPE OF PAPER)

| | PASTE APPLICATION AMOUNT PER UNIT NUMBER (PLAIN PAPER) | PASTE APPLICATION AMOUNT PER UNIT NUMBER (THICK PAPER) |
|---|---|---|
| FIRST PASTE APPLICATION AMOUNT (FOR USUAL MODE) | P1 | P3 |
| SECOND PASTE APPLICATION AMOUNT (FOR SAVING MODE) | P2 (<P1) | P4 (<P3) |

P3>P4>P1>P2

FIG. 8

SCREEN DISPLAY OF PASTE REPLACEMENT REQUIREMENT 56

REMAINING PASTE AMOUNT IS INSUFFICIENT

PLEASE REPLACE PASTE

SHEET PASTING AND BINDING APPARATUS AND SHEET POST-PROCESSING APPARATUS

FIELD

Embodiments described herein relate generally to a technique for generating a sheet bundle by applying paste to continuously fed sheets one by one.

BACKGROUND

In the related art, a sheet post-processing apparatus is provided which includes a sheet pasting and binding apparatus for binding multiple stacked sheets after discharging the sheets onto and stacking the sheets on a processing tray by sequentially receiving the sheets discharged from an image forming apparatus.

The pasting and binding apparatus includes a paste application mechanism which pastes (applies paste to) a portion corresponding to a predetermined binding margin of the sheets and further generates a bundle of multiple sheets by sequentially repeating an operation for stacking the sheets on the pasted portion.

When tape-shaped, solid state, liquid state, or gel state paste is applied to the sheets, it is a general practice that a paste application amount is fixed or varies depending on a size of booklets to be prepared and a type of sheets.

However, depending on the remaining paste amount and the number of sheets for binding, there is a possibility that sheet binding cannot be performed since the remaining amount of the paste is insufficient during sheet pasting work.

Therefore, it is desirable to control the application amount of the paste so as not to be in a situation where the remaining paste amount is insufficient during sheet bundle preparation.

DESCRIPTION OF THE DRAWINGS

FIG. 6 is a memory table illustrating a paste application amount per unit number of sheets.

FIG. 7 is a memory table illustrating a paste application amount per unit number of sheets depending on a type of the sheet (plain paper or thick paper)

FIG. 8 is a display screen illustrating paste replacement requirement in a display unit.

DETAILED DESCRIPTION

According to one embodiment, there is provided a sheet pasting and binding apparatus which performs pasting and binding using paste by continuously receiving sheets. The sheet pasting and binding apparatus includes a paste application unit, a reception number acquisition unit, a remaining paste amount detection unit, and a controller. The paste application unit can change an application amount for applying the paste to the fed sheets. The reception number acquisition unit acquires the number of printing instructed sheets. The remaining paste amount detection unit detects the remaining amount of the paste. The controller controls the paste application unit so that pasting and binding are performed using a second paste application amount which is smaller than a first paste application amount while the pasting and binding are performed using the first paste application amount which is specified in advance as the paste application amount for maintaining a binding force between the sheets, based on the reception number acquired by the reception number acquisition unit and the remaining paste amount detected by the remaining paste amount detection unit.

Hereinafter, a sheet pasting and binding apparatus according to one embodiment will be described in detail with reference to the drawings.

Figure 1:
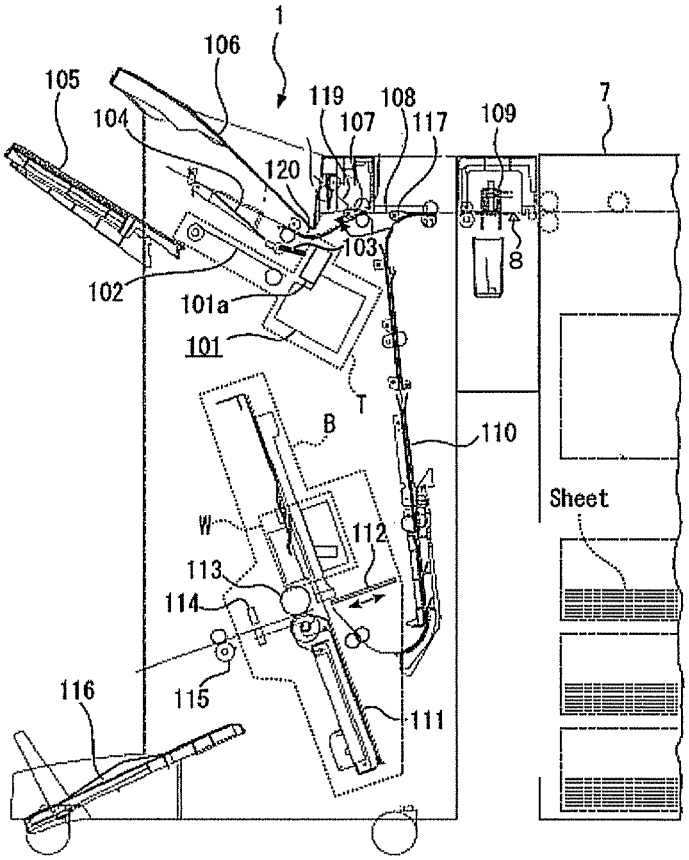
FIG. 1 is a schematic vertical cross-sectional view of a sheet post-processing apparatus according to an embodiment.

FIG. 1 is a schematic view of a sheet post-processing apparatus 1. For example, the sheet post-processing apparatus 1 performs various processes such as sheet binding, sheet folding, and sheet punching by receiving sheets discharged from an image forming apparatus 7 which is connected to the sheet post-processing apparatus 1 so as to be communicable with each other.

The sheet post-processing apparatus 1 mainly includes a sheet pasting and binding apparatus T serving as a process function, a folding unit B, a stapler W, and a punching unit 109. Here, as an example, a configuration was described in which the sheet post-processing apparatus 1 includes the sheet pasting and binding apparatus T, the folding unit B, the stapler W, and the punching unit 109. However, without being limited thereto, the sheet post-processing apparatus 1 may include at least the sheet pasting and binding apparatus T.

The sheet having an image formed in the image forming apparatus 7 first passes through the punching unit 109. When punching is performed on the sheet, the punching unit 109 performs the punching on the sheet at that time.

A transport destination of the sheet passing through the punching unit 109 is switched to any one between a transport path 110 and a transport path 108 by a flapper 117.

If an operator wants to perform only the punching on the sheet, or if the operator wants to discharge the sheet passing through the punching unit 109 outward from the apparatus as it is, the sheet is guided to the transport path 108 by the flapper 117, is further guided to a transport path 119 by a flapper 107, and is discharged onto a first discharge tray 106.

On the other hand, when the operator wants to perform pasting and binding on the sheet by using the sheet pasting and binding apparatus T, the sheet guided to the transport path 108 is further guided to a transport path 120 by the flapper 107, and is temporarily discharged onto a tray 104 (so-called buffer tray).

The sheet temporarily discharged onto the tray 104 is thereafter knocked off by a rotary paddle 103 rotating counterclockwise on the paper surface in FIG. 1, and is stacked on a process tray 102.

The sheet pasting and binding apparatus T includes a paste application unit 101 which applies paste to an upper surface of the sheet stacked on the process tray 102. The sheet pasting and binding apparatus T causes the paste application unit 101 to apply the paste to the upper surface of the sheet each time the sheet is stacked on the process tray 102. That is, paste applying is performed for every single sheet. However, if the operator wants to bind a sheet bundle of 10 sheets, the paste applying is not performed on the upper surface of the tenth sheet (uppermost sheet stacked for the tenth time).

Figure 2:
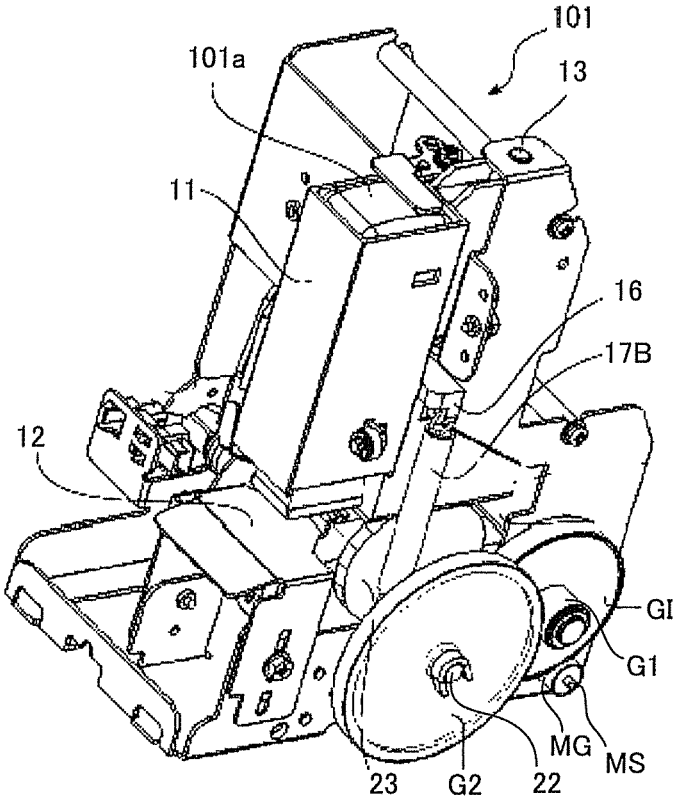
FIG. 2 is a perspective view of a sheet pasting and binding apparatus.
Figure 3:
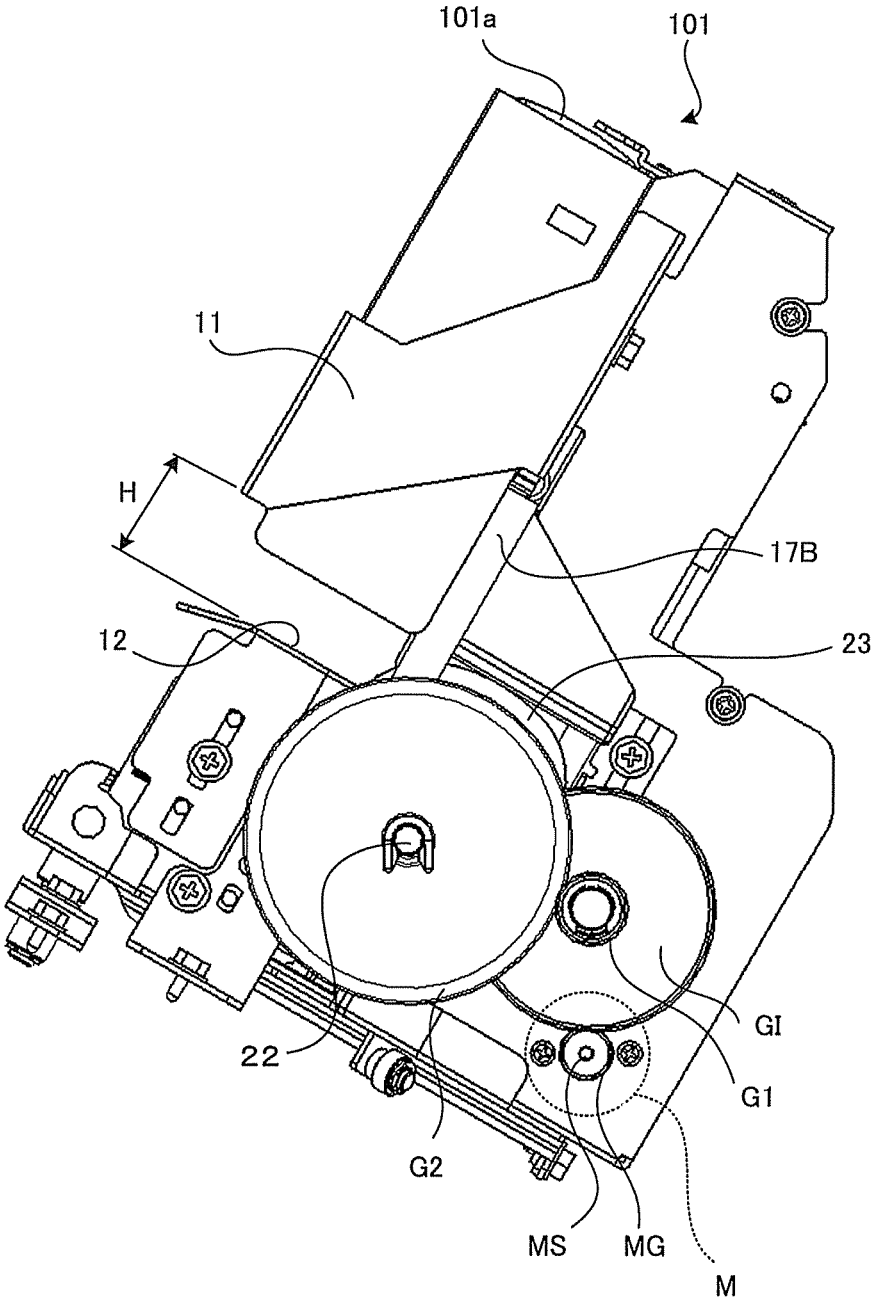
FIG. 3 is a front view of the sheet pasting and binding apparatus.

The paste application unit 101 will be described. As illustrated in FIGS. 2 and 3, the paste application unit 101 has an adhesive application unit 101*a* which is accommodated inside a holder 11 so as to be replaceable, and a pressing force receiving base 12 which is fixedly arranged below the holder 11. The holder 11 is held by a guide shaft 13 so as to be movable along an axial direction. As illustrated in FIG. 3, a waiting position above the holder 11 is a position of a distance H farthest from the pressing force receiving base 12. That is, the number of sheets which fit the distance H represents the number of sheets on which the binding can be performed at a time.

A holder arm 16 is inserted so as to be slidable on the guide shaft 13 along the axial direction. In addition, pressing-down springs 17B configured to have a tension spring are respectively arranged between right and left side surfaces of the holder 11 and a paste application unit substrate (not illustrated). The pressing-down springs 17B bias the holder 11 against the pressing force receiving base 12.

The adhesive application unit 101*a* is a paste application unit which causes the paste serving as a sheet pasting adhesive to adhere to the sheet. Specifically, for example, the paste application unit can employ a method of applying the paste by bringing a mesh containing the paste in a liquid state into contact with the sheet. The "paste" in the embodiment described herein is not limited to the paste in the liquid state, and may be the paste in a solid state or a tape-shape paste. That is, any type may be used as long as the material enables the sheet to adhere to another sheet.

The sheets placed on the process tray 102 (refer to FIG. 1) are brought into a state of being abutted onto an abutment aligning position. In this state, a position for the pasting and binding is placed on the pressing force receiving base 12. Accordingly, if the adhesive application unit 101*a* is pressed down by a spring force of the pressing-down spring 17B, the adhesive application unit 101*a* applies the adhesive to a predetermined region on the upper surface of the sheet.

In FIGS. 2 and 3, a motor gear MG is attached to a motor shaft MS of a motor M. The motor gear MG meshes with an intermediate gear GI. A first transmission gear G1 having a small diameter is coaxially attached to the intermediate gear GI. The first transmission gear G1 meshes with a second transmission gear G2 having a large diameter. A first rotary shaft 22 is attached to the second transmission gear G2. A disk-shaped first cam 23 configuring a vertical movement unit is fixed to the first rotary shaft 22.

In the embodiment described herein, if a sheet bundle is held at a non-pressing position, the motor M is controlled so that the first rotary shaft 22 is rotated clockwise. If the pasted and bound sheet bundle is pressed, the motor M is controlled so that the first rotary shaft 22 is rotated counterclockwise.

If the paste application is completed for all sheets except for the uppermost sheet among the multiple sheets stacked on the process tray 102 which are targets for the binding process, a pressing mechanism presses the sheet bundle in a state where all the multiple sheets configuring the binding-targeted sheet bundle are stacked on one another by overlapping one another. The pressing mechanism presses the sheet bundle, thereby causing an adhesive to firmly adhere to (clamp) a portion between the adjacent sheets in the multiple sheets and then, the sheet binding process is completed.

Figure 4:
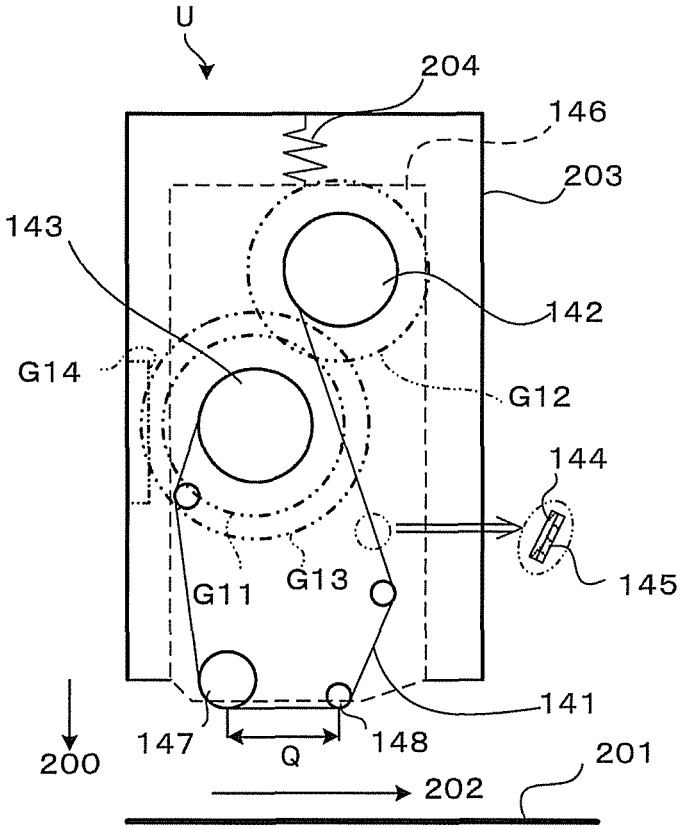
FIG. 4 is a schematic view of another configuration of an adhesive application unit.

As an alternative form, an adhesive application unit U can also employ an adhesive tape method as illustrated in FIG. 4.

In FIG. 4, the adhesive application unit U employs a pressure sensitivity application-type adhesive tape (hereinafter, abbreviated as an adhesive tape) 141 as the paste. The adhesive tape 141 is wound in a roll shape around a feed reel 142, and one end side is wound around a winding reel 143. The adhesive tape 141 adheres to one side surface of a film 144 so that a base material 145 serving as the paste can be peeled off via an adhesive layer. The adhesive tape 141 is configured to include the film 144 and the base material 145 serving as the paste. The base material 145 has double-sided adhesive, and is peeled off from the film 144 in an application region where the base material 145 is applied to an adherend surface.

The feed reel 142 and the winding reel 143 are rotatably supported by a substrate 146, and are laid via rollers 147 and 148 disposed in a distal end portion of the substrate 146. The adhesive application unit U lowers the substrate 146 in an arrow direction 200 when the length between the roller 147 and the roller 148 represents a pressing application region Q. The adhesive application unit U presses the base material 145 of the adhesive tape 141 against an adherend surface 201, and thereafter causes the substrate 146 to return upward. In this manner, the base material 145 in the pressing application region Q is applied to the adherend surface 201.

In the embodiment described herein, the substrate 146 is arranged so as to be vertically movable inside an exterior case 203. A spring member 204 biases the substrate 146 downward in the drawing from the exterior case 203. A first gear G11 is coaxially fixed to the winding reel 143. A second gear G12 is coaxially fixed to the feed reel 142. The first gear G11 and the second gear G12 mesh with each other. Accordingly, if the adhesive tape 141 is pulled in a winding direction, the first gear G11 is rotated counterclockwise, and the winding reel 143 with the second gear G12 is rotated clockwise. The adhesive tape 141 is wound around the winding reel 143.

A third gear G13 is attached to the winding reel 143 coaxially with the second gear G12 via a one-way clutch mechanism (not illustrated). A rack gear G14 is attached to the inside of the exterior case 203. The third gear G13 meshes with the rack gear G14. If the third gear G13 is rotated clockwise, the above-described one-way clutch mechanism connects the third gear G13 and the winding reel 143 to each other. A rotation force of the third gear G13 causes the adhesive tape 141 to be wound around the winding reel 143.

On the other hand, if the winding reel 143 is rotated clockwise, the above-described one-way clutch mechanism disconnects the third gear G13 and the winding reel 143 from each other. Only the winding reel 143 is rotated in the winding direction.

If the substrate 146 is pressed downward from the exterior case 203 by a spring force of the spring member 204, the third gear G13 is rotated clockwise by meshing with the rack gear G14, and the adhesive tape 141 is wound around the winding reel 143. That is, when the exterior case 203 is moved upward after the base material 145 is applied, in synchronization with the substrate 146 pressed downward by the spring force of the spring member 204, the adhesive tape 141 is wound around the winding reel 143 by a predetermined amount, and the substrate 146 is located in the pressing application region Q.

If the exterior case 203 is moved in an arrow direction 202 in a pressed state, the base material 145 of the adhesive tape 141 adheres to the adherend surface (sheet surface) 201 in accordance with a movement length.

Here, a length 2Q twice the pressing application region Q allows an application amount (in some cases, referred to as a usual application amount or a first application amount) which can ensure a normal binding force for the plain paper and which is specified in advance. Then, the length of the pressing application region Q is set to the length by which the normal binding force cannot be obtained but the minimum binding force can be obtained. The embodiment described herein employs the length of the pressing application region Q. However, without being limited thereto, any length may be employed as long as the length allows a binding force weaker than the normal binding force.

Referring back to FIG. 1, an operation in folding and stapling will be described. When the folding and the stapling are performed on the sheet passing through the punching unit 109, the sheet is guided to the transport path 110 by the flapper 117. The sheet discharged to a stacker 111 is subjected to the stapling by a stapler W, and is subjected to the folding by a folding unit B. Specifically, for example, in the folding unit B, a sheet bundle subjected to the stapling by the stapler W is folded by using a folding blade 112 and a folding roller 113. The folded section of the sheet bundle is further pinched between additionally folding rollers 114. Thereafter, the folded sheet bundle is discharged onto a third discharge tray 116 by a discharge roller 115.

The sheet bundle having the multiple sheets bound during the binding is thereafter discharged onto a second discharge tray 105 by a discharge member (not illustrated) disposed in the process tray 102, for example. In addition, the number of sheets fed to the process tray 102 can be acquired by a sheet detection sensor 8 disposed on a sheet supply port side which receives the sheet from the image forming apparatus 7.

Furthermore, the reception number (N) of sheets to be printed can be acquired from the image forming apparatus 7. For example, when printing data is transmitted from a personal computer to the image forming apparatus 7, the printing data includes the reception number (N) which represents the total number of sheets to be printed. In addition, when multiple original documents are read by an auto document feeder (ADF) of the image forming apparatus 7, printing starts after all original documents are read. Therefore, the reception number (N) of sheets to be printed can be acquired based on the number of original documents read by the ADF. For example, the reception number (N) of sheets is recorded in a memory 52 of a controller 50 illustrated in FIG. 5. When the multiple original documents are read in the ADF of the image forming apparatus 7, the printing may start before all original documents are read. In this case, printing speed is slower than reading speed in the ADF. Accordingly, a configuration may be adopted in which the number of sheet bundles is recorded in the memory 52 of the controller 50 at the timing when the reading is completed while the reading is performed in parallel with the printing.

Figure 5:
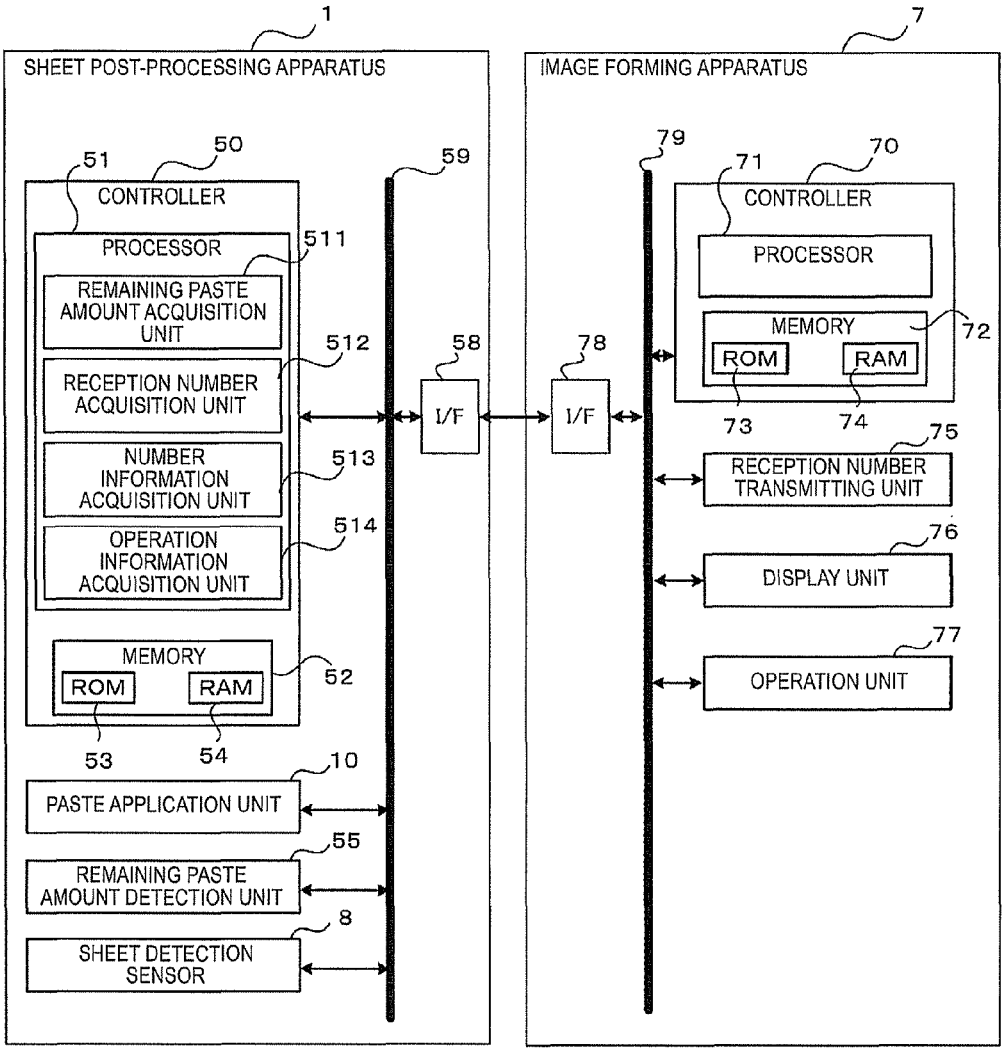
FIG. 5 is a diagram illustrating a control block of a hardware configuration in the sheet pasting and binding apparatus.

FIG. 5 is a diagram illustrating a control block of a hardware configuration in the sheet pasting and the binding apparatus T. In addition, FIG. 6 is a memory table illustrating a paste application amount per unit number of sheets, and FIG. 7 is a memory table illustrating a paste application amount per unit number of sheets depending on a type of the sheets (plain paper or thick paper).

In FIG. 5, the sheet post-processing apparatus 1 has the controller 50 for controlling the overall sheet post-processing apparatus 1, a paste application unit 10, a remaining paste amount detection unit 55 for detecting the remaining paste amount of the paste application unit 10, and the sheet detection sensor 8 for detecting the sheet fed to the sheet post-processing apparatus 1, and further has a bus line 59 to which these components are connected.

For example, in a case of the tape paste illustrated in FIG. 4, the remaining paste amount detection unit 55 detects the length of the remaining tape. The tape illustrated in FIG. 4 has one or more marks. The remaining paste amount detection unit 55 is configured to include a CCD sensor or the like which reads a position of the mark (distance from a terminal end of the paste tape) or a form of the mark. A remaining paste amount (R) which represents the length of the remaining tape is recorded in a ROM 53 so as to correspond to the position of the mark or the form of the mark. The remaining paste amount detection unit 55 derives the length (remaining paste amount) of the remaining tape, based on the record.

Based on a pasting and binding program recorded in the memory 52, the controller 50 performs pasting and binding on pasting and binding-targeted sheets. A paste saving mode is set in the pasting and binding program. If the total number (reception number) of pasting and binding-targeted sheets in one bundle is set to N during the pasting and binding, it is unnecessary to apply the paste to the last one sheet. Accordingly, the paste is applied to the number (N−1) of the sheets.

For example, the controller 50 has a processor 51 which is a central processing unit (CPU) or a micro processing unit (MPU). The processor 51 has a remaining paste amount acquisition unit 511 which acquires a remaining paste amount R detected by the remaining paste amount detection unit 55, a reception number acquisition unit 512 which acquires the reception number (N) transmitted from the image forming apparatus 7, a number information acquisition unit 513 which acquires detection information of the sheet detected by the sheet detection sensor 8, and an operation information acquisition unit 514 which acquires operation information transmitted from the image forming apparatus 7.

The memory 52 is a storage unit which stores data in a volatile manner or in a non-volatile manner, and has a read only memory (ROM) 53 which stores various control programs and the reception number (N), and a random access memory (RAM) 54 which provides the processor 51 with a temporary work region.

The sheet post-processing apparatus 1 has an Interface (I/F) 58, and the image forming apparatus 7 has an I/F 78. In the embodiment described herein, the I/F 58 and the I/F 78 are physically connected to each other, thereby allowing the apparatuses to exchange data.

Next, a configuration of the image forming apparatus 7 will be described. The image forming apparatus 7 has a controller 70, a reception number transmitting unit 75 which transmits the reception number of printing sheets to the sheet post-processing apparatus 1, a touch panel-type display unit 76, and an operation unit 77 which is configured to include switches for instructing various operations. In addition, the image forming apparatus 7 further has a bus line 79 to which these components are connected. The controller 70 has a processor 71 which is the CPU or the MPU, and a memory 72. The memory 72 has a ROM 73 and a RAM 74. The ROM 73 and the RAM 74 respectively have the same functions as described above.

Next, data stored in the ROM 53 of the sheet post-processing apparatus 1 will be described. For example, the memory tables illustrated in FIGS. 6 and 7 are recorded in the ROM 53. In the memory table of FIG. 6, with regard to a paste application amount per a unit number, a first paste application amount (usual mode) which represents a normal paste application amount is set to P1, and a second paste application amount for the paste saving mode is set to P2 (P1>P2). In an example of the tape paste in FIG. 4, for example, the first paste application amount can be set to 2Q, and the second paste application amount P2 can be set to Q<P2<2Q. The reference numerals Q and 2Q are examples in order to facilitate the description. Accordingly, in practice, the paste application amount is set depending on a type of the paste.

The paste saving mode represents a mode in which all pasting and binding-targeted sheets can be pasted and bound using a paste amount smaller than the normal paste amount and can be pasted and bound using a binding force enabling the sheets to maintain the joining.

FIG. 7 illustrates a first paste application amount and a second paste application amount with regard to a paste application amount per a unit number in a case where sheets are respectively a plain paper and a thick paper. The first paste application amount for the thick paper is set to P3, and the second paste application amount for the thick paper is set to P4 (P3>P4). Since the sheet of the thick paper is stiff, the paste of the thick paper is more likely to be peeled off than the paste of the plain paper. Therefore, the first paste application amount P3 and the second paste application amount P4 are set to be greater than the normal paste application amount P1 for the plain paper (P3>P4>P1>P2).

If the reception number recorded in the memory 52 is set to N, the number of paste applications becomes (N−1). The processor 51 of the controller 50 determines whether or not the number (N−1) of paste applications is available by using the remaining paste amount (R) detected by the remaining paste amount detection unit 55. If the sheet is the plain paper, the processor 51 determined whether or not the number (N−1) of paste applications is available by using the remaining paste amount (R) rather than the first paste application amount P1. That is, in a case of R≥P1×(N−1), the pasting and binding are available by using the first application amount.

On the other hand, if it is determined that the pasting and binding are not available by using the first paste application amount P1, the processor 51 determines whether or not the pasting and binding are available in a paste saving mode. In the paste saving mode, it is determined whether or not the number (N−1) of paste applications is available by using the second paste application amount P2 within the remaining paste amount R. If the paste amount which can be used for every one sheet is set to X, X can be obtained by X=R/(N−1). If the paste amount X is equal to or greater than the second paste application amount P2 (X≥P2), the pasting and binding are performed in the paste saving mode.

A case of the thick paper is the same as described above. If the pasting and binding are not available, the display unit 76 of the image forming apparatus 7 displays messages such as "the remaining paste amount is insufficient" and "please replace the paste" (refer to FIG. 8)

Figure 9:
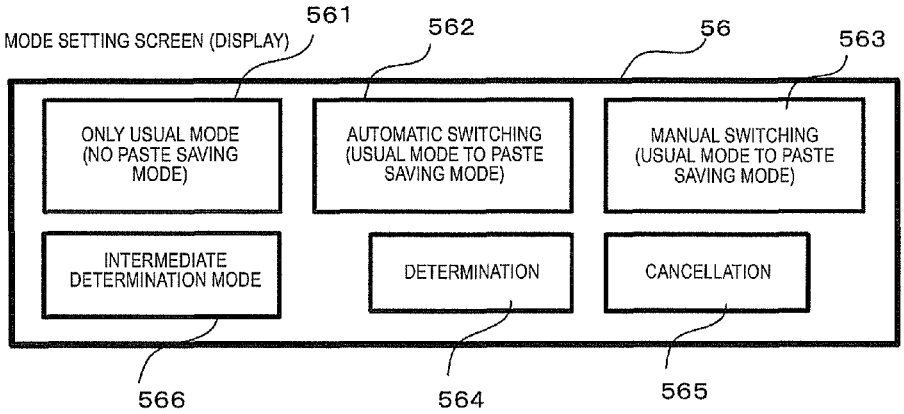
FIG. 9 is a diagram illustrating a mode setting screen in the display unit.

Setting whether or not the process is performed in the paste saving mode, and setting whether a usual switching between the pasting and binding mode and the paste saving mode is performed automatically or manually are performed on a mode setting screen 56 displayed on the display unit 76 as illustrated in FIG. 9. The mode setting screen 56 displays a usual mode setting unit 561 for setting only the usual pasting and binding (no paste saving mode), an automatic switching mode setting unit 562 for automatically switching the usual mode to the paste saving mode, and a manual switching mode setting unit 563 for manually switching the usual mode to the paste saving mode.

Then, if a user selects any one display on the screen in the mode setting units 561 to 563 and then selects a determination unit 564 on the mode setting screen 56, the selected setting information is acquired by the operation information acquisition unit 514 of the processor 51. If the user selects a display of a cancellation unit 565, the mode set by the mode setting units 561 to 563 is cancelled. For example, if the display unit 76 displays that the pasting and binding are insufficiently performed by using the first paste application amount P1, when the user instructs switching of the paste saving mode, the manual switching mode setting unit 563 outputs a signal. The operation information acquisition unit 514 functions as a reception unit for receiving the signal indicating whether to execute the paste saving mode from the manual switching mode setting unit 563.

In addition, if the user selects an intermediate determination mode setting unit 566, during an intermediate course of the pasting and binding, it is determined whether or not the pasting and binding are completed for each sheet by the number (n) of remaining sheets at that time. In this case, sheet detection information detected by the sheet detection sensor 8 is acquired by the number information acquisition unit 513.

The sheet detection information acquired by the number information acquisition unit 513 is information indicating that the sheet is detected. Accordingly, it is possible to obtain the number m of previously pasted and bound sheets by counting the sheet detection information. Therefore, the number n of remaining sheets is obtained as n=(N−m) from the reception number N and the number m of the pasted and bound sheets.

In the embodiment described herein, a state where the remaining paste amount R reaches a predetermined remaining amount is referred to as a paste near-end state. Based on the first paste application amount P1, it is determined whether or not the paste amount for pasting and binding the number (n−1) of sheets exceeds the remaining paste amount R. That is, in a case of R>{(n−1)×P1}, the remaining paste amount R is sufficient. However, in the contrary case, since the remaining paste amount R is insufficient, the process proceeds to the paste saving mode.

Figure 10:
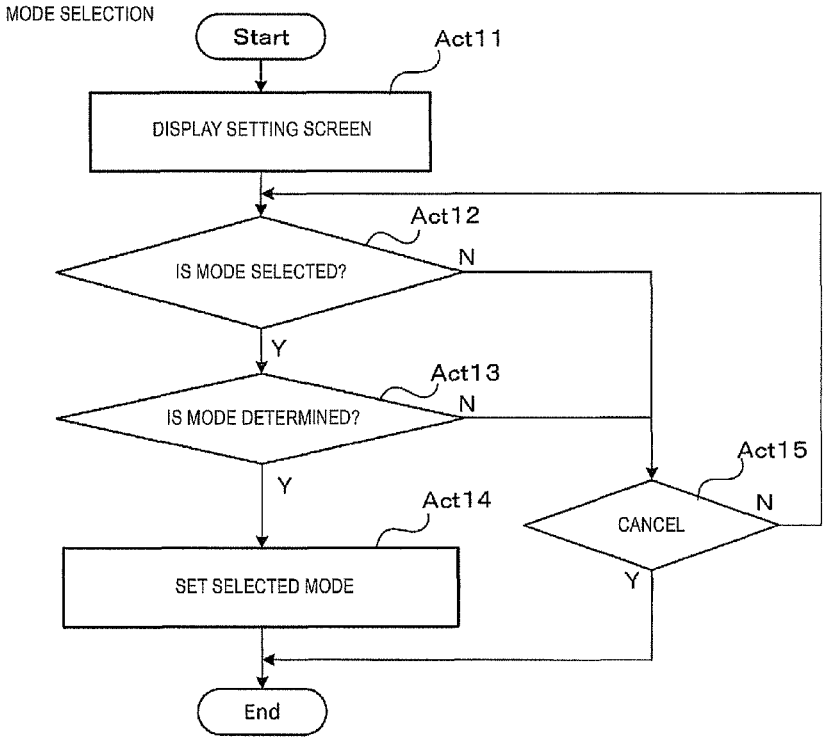
FIG. 10 is a flowchart for illustrating a mode selecting flow.

A mode selecting flow will be described with reference to a flowchart illustrated in FIG. 10.

In Act 11, the display unit 76 displays the mode setting screen 56 illustrated in FIG. 9, and the flow proceeds to Act 12.

In Act 12, the operation information acquisition unit 514 determines whether or not a user performs mode selection. If the user performs the mode selection (Yes), the flow proceeds to Act 13. If the user does not perform the mode selection (No), the flow proceeds to Act 15.

In Act 13, if the determination unit 564 is turned on (Yes), the flow proceeds to Act 14. If the mode is not determined (No), the flow proceeds to Act 15.

In Act 14, the processor 51 sets the selected mode, and completes the flow.

In Act 15, if the cancellation unit 565 is turned on (Yes), the processor 51 completes the flow. If the cancellation unit 565 is not turned on (No), the flow returns to Act 12.

Figure 11:
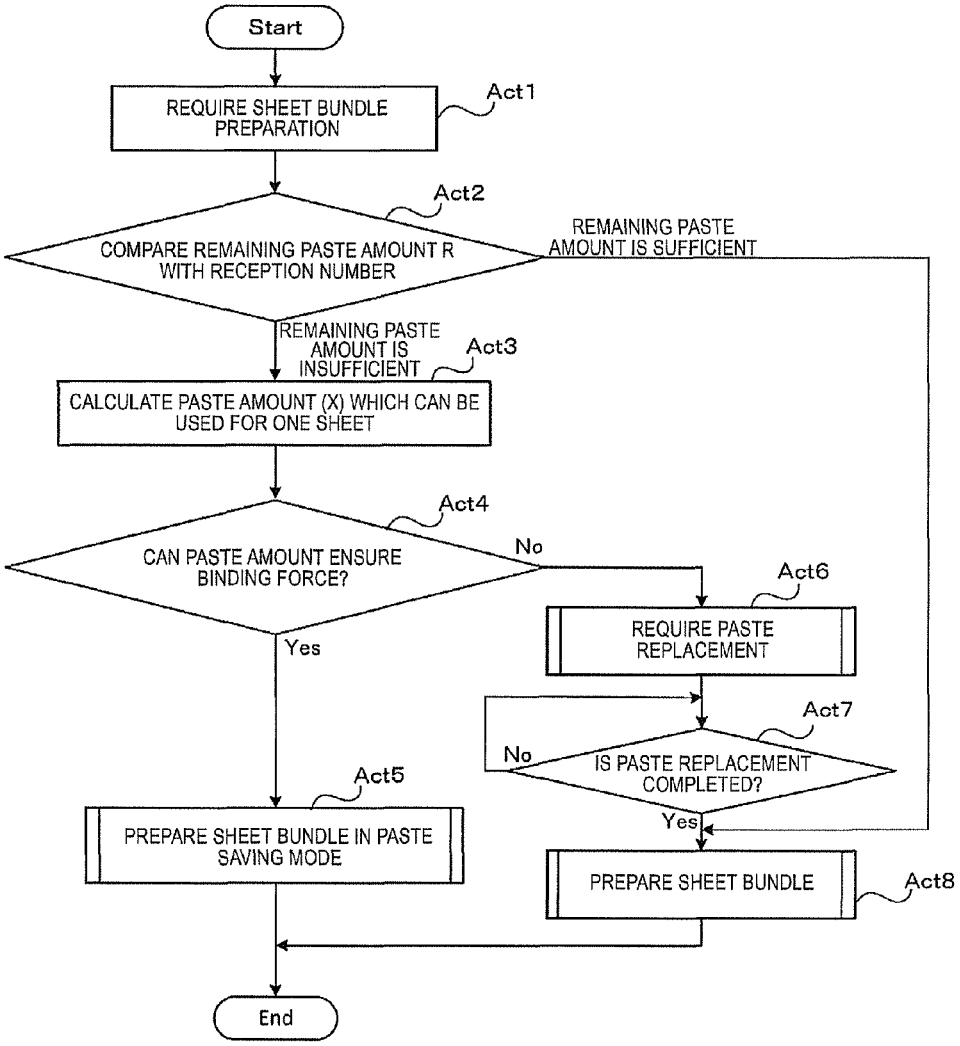
FIG. 11 is a flowchart for illustrating a flow of determining whether or not pasting and binding are automatically available in a paste saving mode before sheet pasting and binding start.

With regard to the mode setting screen 56 in FIG. 9, pasting and binding flow when the automatic switching mode setting unit 562 is selected will be described with reference to a flowchart illustrated in FIG. 11. Description will be made based on the assumption that a binding-targeted sheet is the plain paper.

In Act 1, for example, if a user requires preparation of sheet pasting and binding through the operation unit 77 of the image forming apparatus 7 (ON), the flow proceeds to Act 2.

In Act 2, the processor 51 compares the remaining paste amount (R) acquired by the remaining paste amount acquisition unit 511 with the reception number N acquired by the reception number acquisition unit 512 (first determination unit). That is, the processor 51 determines whether the remaining paste amount R is insufficient or sufficient when the number (N−1) of sheets is printed using the first paste application amount P1 ($R \geq P1 \times (N-1)$ ). If it is determined that the remaining paste amount R is insufficient, the flow proceeds to Act 3 in order to be switched over to the paste saving mode. If it is determined that the remaining paste amount R is sufficient, the flow proceeds to Act 8.

In Act 3, the processor 51 calculates a paste amount X which can be used for every one sheet based on the remaining paste amount R and the number (N−1), and the flow proceeds to Act 4.

In Act 4, the processor 51 determines whether or not a binding force can be ensured by the calculated paste amount X (second determination unit). If the binding force can be ensured (Yes), the flow proceeds to Act 5. If the binding force cannot be ensured (No), the flow proceeds to Act 6. If the paste application amount which can ensure the binding force is set to the second paste application amount P2, in Act 4, the processor 51 determines whether the equation $X \geq P2$ is established.

In Act 5, the sheet post-processing apparatus 1 prepares a sheet bundle in the paste saving mode. The sheet post-processing apparatus 1 prepares the sheet bundle by applying the paste to the sheet one by one and by binding a sheet to a sheet.

In Act 6, the display unit 76 displays paste replacement requirement illustrated in FIG. 8, and the flow proceeds to Act 7.

In Act 7, if the processor 51 of the sheet post-processing apparatus 1 determines that the paste replacement is performed, the flow proceeds to Act 8.

In Act 8, the paste application unit 10 performs the pasting and binding by using the first paste application amount P1, and the flow is completed.

Figure 12:
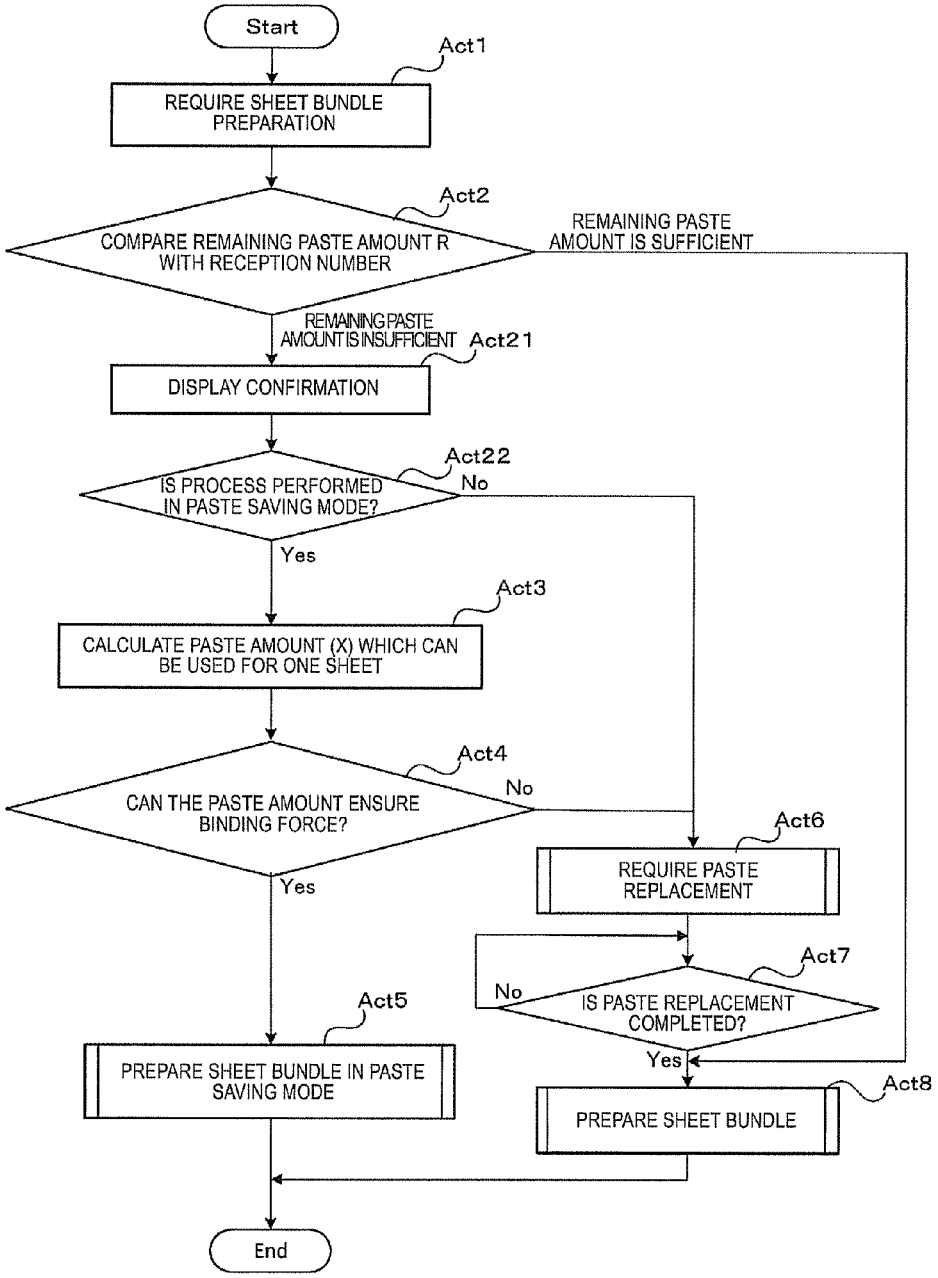
FIG. 12 is a flowchart for illustrating a manual selecting flow on whether or not pasting and binding are performed in the paste saving mode before the sheet pasting and binding start.

Next, pasting and binding when the manual switching mode setting unit 563 is selected will be described with reference to a flowchart illustrated in FIG. 12. In the manual switching mode, before the pasting and binding of the sheets starts, a user manually selects whether or not the pasting and binding are performed in the paste saving mode. The flow in the manually switching mode is basically the same as the flow in the automatic switching mode illustrated in FIG. 11. Accordingly, the same reference numerals (Act Numbers) will be given to operation units for performing the same process, and description thereof will be omitted. Different operation units (Acts 21 to 23) will be described.

In Act 2, the processor 51 compares the remaining paste amount (R) acquired by the remaining paste amount acquisition unit 511 with the reception number N acquired by the reception number acquisition unit 512. If the processor 51 determines that the remaining paste amount R is insufficient, the flow proceeds to Act 21.

In Act 21, the display unit 76 displays whether or not the mode is switched over to the manual mode, and the flow proceeds to Act 22.

In Act 22, in accordance with a user's instruction acquired by the operation information acquisition unit 514, the processor 51 determines whether or not the paste saving mode is executed. When the mode is manually switched over to the paste saving mode (Yes), the flow proceeds to Act 3. When the mode cannot be switched over to the paste saving mode (No), the flow proceeds to Act 6.

Figure 13:
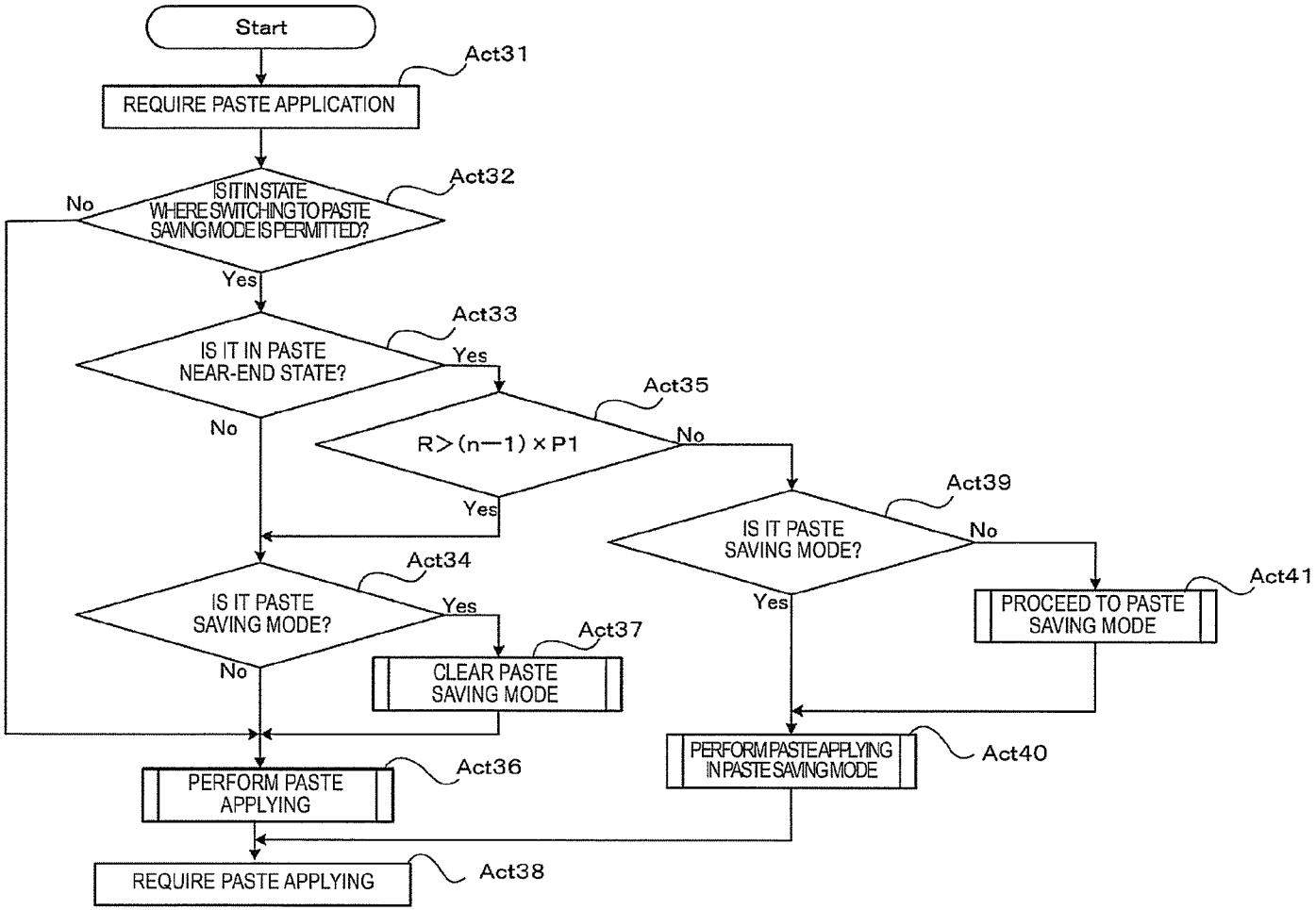
FIG. 13 is a flowchart for illustrating a flow where sheet pasting and binding is performed by automatically proceeding to the paste saving mode and reducing a paste application amount when it is detected that the remaining amount of the paste is insufficient during an operation of the pasting and binding process.

FIG. 13 is a flowchart for illustrating a flow in which pasting and binding are performed on sheets by the mode being automatically switched over to the paste saving mode so as to reduce the paste application amount when the remaining paste amount is detected to be insufficient during the pasting and binding operation.

In Act 31, if the operation information acquisition unit 514 acquires information relating to paste application requirement from the operation unit 77, the flow proceeds to Act 32.

In Act 32, in accordance with a user's instruction acquired by the operation information acquisition unit 514, the processor 51 determines whether or not setting is made so that the mode is automatically switched over to the paste saving mode. When the setting is made so that the mode is automatically switched over to the paste saving mode (Yes), the flow proceeds to Act 33. When the setting is not made so that the mode is automatically switched over to the paste saving mode (No), the flow proceeds to Act 36.

In Act 33, the processor 51 determines whether or not the current state is a paste near-end state. The paste near-end state represents a state where the remaining paste amount R reaches a predetermined remaining amount. If the current state is the paste near-end state, the flow proceeds to Act 35. If not, the flow proceeds to Act 34.

In Act 34, it is determined whether or not the mode is set to the paste saving mode. If the mode is not set to the paste saving mode (No), the flow proceeds to Act 36. If the mode is set to the paste saving mode (Yes), the flow proceeds to Act 37. In Act 37, the paste saving mode is cleared, and the flow proceeds to Act 36. In the embodiment described herein, if the paste saving mode is set, it is assumed that a state in the paste saving mode is also maintained thereafter. Accordingly, if a user wants to discontinue the operation in the paste saving mode, the user clears the setting of the paste saving mode.

In Act 36, usual paste applying is performed using the first paste application amount P1, and the flow proceeds to Act 38. Then, information relating to subsequent paste application requirement is acquired. Act 38 serves as Act 31 for the next sheet. Next, operations subsequent to Act 32 will continue.

In Act 35, it is determined whether or not the number (n−1) of sheets can be pasted and bound using the first paste application amount P1 within the remaining paste amount R ($R > P1 \times (n-1)$ ). If the determination result shows the pasting and binding are available, the flow proceeds to Act 34. If the determination result shows the pasting and binding are not available, the flow proceeds to Act 39.

In Act 39, the processor 51 determines whether or not the paste saving mode is set. If the paste saving mode is set (Yes), the flow proceeds to Act 40. Then, the paste application unit 10 performs the pasting and binding using the second paste application amount P2, and the flow proceeds to Act 38. If the paste saving mode is not set (No), the flow proceeds to Act 41.

In Act 41, the processor 51 sets the mode to the paste saving mode. Accordingly, the mode is switched over to the paste saving mode, and the flow proceeds to Act 40.

In the embodiment described herein, the paste application method was described as a method of applying paste to sheets. However, embodiments described herein are not limited thereto. That is, in addition to the method of providing the sheets with the paste through paste application, the paste application may be performed by using a method of spraying liquid state paste (adhesive) onto the sheets, or a method of applying stick-shaped solid paste (adhesive) to the sheets.

Without departing from the spirit or the essential advantages, the embodiment described herein can be modified in various ways. Therefore, the above-described embodiment is merely an example in various viewpoints, and is not construed as limiting. The scope of the embodiments described herein is disclosed in claims, and is not limited to the description. Furthermore, all variations, various improvements, alternatives, and modifications which belong to a scope equivalent to the scope of claims are included in the scope of the embodiments described herein.

What is claimed is:

1. A sheet pasting and binding apparatus which performs pasting and binding using paste by continuously receiving sheets, the apparatus comprising:

a paste application unit that can change an application amount for applying the paste to the fed sheets;

a reception number acquisition unit that acquires the number of printing instructed sheets;

a remaining paste amount detection unit that detects the remaining amount of the paste; and a controller that controls the paste application unit so that pasting and binding are performed using a second paste application amount which is smaller than a first paste application amount while the pasting and binding are performed using the first paste application amount which is specified in advance as the paste application amount for maintaining a binding force between the sheets, based on the reception number acquired by the reception number acquisition unit and the remaining paste amount detected by the remaining paste amount detection unit.

2. The apparatus according to claim 1, wherein based on the first paste application amount, the controller determines whether or not paste application is available for the reception number of sheets which is acquired by the reception number acquisition unit, using the remaining paste amount acquired by the remaining paste amount detection unit, and wherein if the controller determines that the paste application is not available, the controller determines whether or not the pasting and binding can be performed using the second paste application amount.

3. The apparatus according to claim 2, wherein if a determination result relating to the first paste application amount shows that the paste application is not available, the controller calculates a paste amount which can be used per one sheet based on the reception number and the remaining paste amount, and determines whether or not the calculated paste amount is equal to or greater than the second paste application amount.

4. The apparatus according to claim 2, wherein if a determination result relating to the second paste application amount shows that the pasting and binding cannot be performed, the controller causes a display unit to display a paste replacement requirement.

5. The apparatus according to claim 1, wherein the first paste application amount is set to have a different value depending on the thickness of the sheets.

6. The apparatus according to claim 2, wherein if a determination result relating to the first paste application amount shows that the paste application is not available, the controller performs determination relating to the second paste application amount after receiving a user's instruction.

7. A sheet post-processing apparatus which performs pasting and binding using paste by continuously receiving sheets, the apparatus comprising:

a paste application unit that can change an application amount for applying the paste to the fed sheets;

a reception number acquisition unit that acquires the number of printing instructed sheets;

a sheet detection sensor that detects the fed sheets;

remaining paste amount detection unit that detects the remaining amount of the paste; and a controller that controls the paste application unit so that pasting and binding are performed using a second paste application amount which is smaller than a first paste application amount while the pasting and binding are performed using the first paste application amount which is specified in advance as the paste application amount for maintaining a binding force between the sheets, for the remaining sheets obtained by the reception number acquired from the reception number acquisition unit and the number of fed sheets which is acquired from the sheet detection sensor, based on a predetermined remaining paste amount, if the remaining paste amount acquired from the remaining paste amount detection unit is the predetermined remaining paste amount.

8. The apparatus according to claim 7, wherein the controller includes a number information acquisition unit which acquires sheet number information detected by the sheet detection sensor, and wherein based on the first paste application amount, the controller determines whether, or not the paste application is available using the predetermined remaining paste amount acquired by the remaining paste amount acquisition unit, for the remaining sheets obtained by the reception number acquired from the reception number acquisition unit and the number of fed sheets which is acquired from the number information acquisition unit.

9. The apparatus according to claim 8, wherein if the determination result shows that the paste application is not available, the controller performs the pasting and binding using the second paste application amount.

10. The apparatus according to claim 9, wherein the controller causes a process to proceed from a mode for performing paste applying using the first paste application amount to a mode for performing paste applying using the second paste application amount.

* * * * *